US011208922B2

(12) United States Patent
Vance

(10) Patent No.: US 11,208,922 B2
(45) Date of Patent: Dec. 28, 2021

(54) ACTUATION APPARATUS

(71) Applicant: EATON INTELLIGENT POWER LIMITED, Dublin (IE)

(72) Inventor: Matthew Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/499,337

(22) PCT Filed: Nov. 24, 2017

(86) PCT No.: PCT/EP2017/080410
§ 371 (c)(1),
(2) Date: Sep. 30, 2019

(87) PCT Pub. No.: WO2018/177576
PCT Pub. Date: Oct. 4, 2018

(65) Prior Publication Data

US 2021/0102479 A1 Apr. 8, 2021

(30) Foreign Application Priority Data

Mar. 30, 2017 (GB) ..... 1705126

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 13/0036* (2013.01);
(Continued)

(58) Field of Classification Search
CPC ... F01L 1/185; F01L 13/0005; F01L 13/0036; F01L 2013/001; F01L 2013/106; F01L 2305/00; F01L 2013/105; F01L 2001/186
See application file for complete search history.

(56) References Cited

U.S. PATENT DOCUMENTS 5,653,198 A 8/1997 Diggs
6,318,318 B1 * 11/2001 Jahr ..... F01L 13/0005 123/90.16
9,470,116 B2 * 10/2016 Cecur ..... F02M 26/01

FOREIGN PATENT DOCUMENTS

DE 19700316 A1 7/1997
DE 102015002982 A1 9/2016
(Continued)

*Primary Examiner* — Zelalem Eshete
(74) *Attorney, Agent, or Firm* — Mei & Mark, LLP

(57) ABSTRACT

An actuation transmission apparatus for actuating a latching arrangement for latching and unlatching a first body and a second body of a switchable valve train component of an internal combustion engine, the latching arrangement being biased from an unlatched position where the first body and the second body are unlatched towards a latched position where the latching arrangement latches the first body and the second body together, the actuation transmission apparatus including: a shaft rotatable by an actuation source; a contacting element for contacting the latching arrangement; and a biasing device for biasing the contacting element rotationally with respect to the shaft. In use, the biasing device becomes biased by the shaft when the actuation source rotates the shaft when the actuation source attempts to actuate the latching arrangement to the unlatched position, via the contacting element, when the latching arrangement is in an un-actuatable state.

15 Claims, 4 Drawing Sheets

(52) U.S. Cl.
CPC ... *F01L 2001/186* (2013.01); *F01L 2013/001* (2013.01); *F01L 2013/105* (2013.01); *F01L 2013/106* (2013.01); *F01L 2305/00* (2020.05)

(56) References Cited

FOREIGN PATENT DOCUMENTS

| | | | |
|---|---|---|---|
| EP | 1544422 | A1 | 6/2005 |
| GB | 2526554 | A | 12/2015 |
| WO | WO 2013156610 | A1 | 10/2013 |

* cited by examiner

ACTUATION APPARATUS

CROSS-REFERENCE TO PRIOR APPLICATIONS

This application is a U.S. National Phase application under 35 U.S.C. § 371 of International Application No. PCT/EP2017/080410, filed on Nov. 24, 2017, and claims benefit to British Patent Application No. GB 1705126.9, filed on Mar. 30, 2017. The International Application was published in English on Oct. 4, 2018 as WO/2018/177576 under PCT Article 21(2).

FIELD

The present invention relates to actuation, and more specifically actuation of latching arrangement of a switchable engine or valve train component for an internal combustion engine.

BACKGROUND

Internal combustion engines may comprise switchable engine or valve train components. For example, valve train assemblies may comprise a switchable rocker arm to provide for control of valve actuation by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

The transmission of an actuation force to a latch pin can be difficult due to packaging constraints and functional requirements. Also, in some cases, actuation may not be possible immediately due to an engine condition.

It is desirable to provide an actuation transmission apparatus that addresses these problems.

SUMMARY

In an embodiment, the present invention provides an actuation transmission apparatus for actuating a latching arrangement for latching and unlatching a first body and a second body of a switchable valve train component of an internal combustion engine, the latching arrangement being biased from an unlatched position where the first body and the second body are unlatched towards a latched position where the latching arrangement latches the first body and the second body together, the actuation transmission apparatus comprising: a shaft rotatable by an actuation source; a contacting element configured to contact the latching arrangement; and a biasing device configured to bias the contacting element rotationally with respect to the shaft; wherein, in use, the biasing device is configured to become biased by the shaft when the actuation source rotates the shaft when the actuation source attempts to actuate the latching arrangement to the unlatched position, via the contacting element, when the latching arrangement is in an un-actuatable state, whereby the biasing device is configured to cause the contacting element to actuate the latching arrangement to the unlatched position when the latching arrangement becomes actuatable again.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
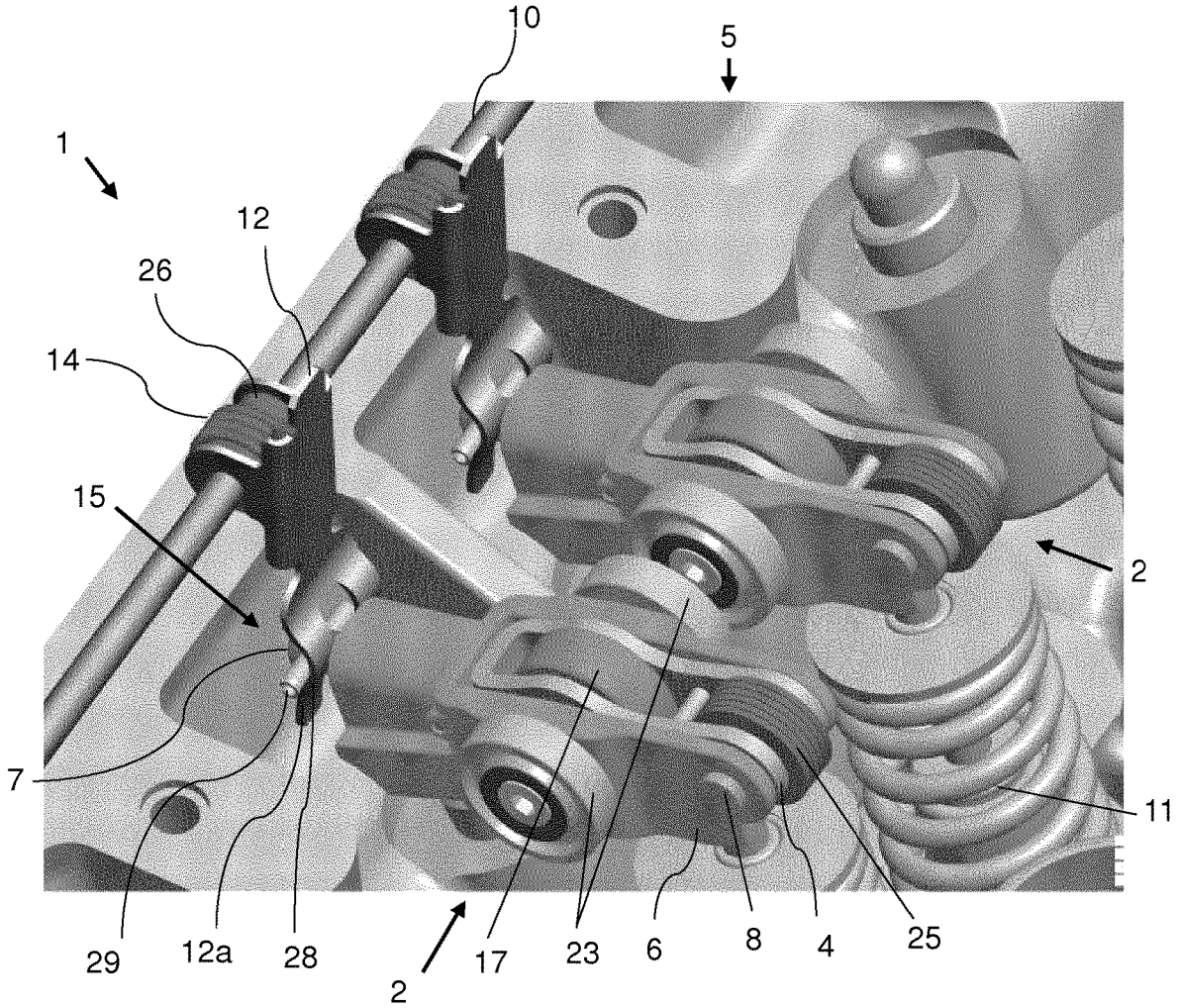
FIG. 1 illustrates a schematic perspective view of a portion of a valve train assembly.

In an embodiment, the present invention provides an actuation transmission apparatus for actuating a latching arrangement for latching and unlatching a first body and a second body of a switchable valve train component of an internal combustion engine, the latching arrangement being biased from an unlatched position where the first body and the second body are unlatched towards a latched position where the latching arrangement latches the first body and the second body together, the actuation transmission apparatus comprising: a shaft rotatable by an actuation source; a contacting element for contacting the latching arrangement; and a biasing device to bias the contacting element rotationally with respect to the shaft; wherein, in use, the biasing device becomes biased by the shaft when the actuation source rotates the shaft when the actuation source attempts to actuate the latching arrangement to the unlatched position, via the contacting element, when the latching arrangement is in an un-actuatable state, whereby the biasing device causes the contacting element to actuate the latching arrangement to the unlatched position when the latching arrangement becomes actuatable again.

The biasing device may be a coil spring arranged around the shaft.

The actuation transmission apparatus may comprise a pre-load element for transferring a torque from the shaft to the coil spring.

A first end of the coil spring may contact a protrusion of the pre-load element, and a second end of the coil spring may contact the contacting element, thereby to bias the contacting element rotationally with respect to the shaft.

The contacting element may extend radially from the shaft.

When the actuation source rotates the shaft when the actuation source attempts to actuate the latching arrangement, via the contacting element, when the latching arrangement is actuatable, the contacting element may actuate the latching arrangement to the unlatched position immediately.

The actuation transmission apparatus may comprise a plurality of contacting elements for contacting a respective plurality of latching arrangements of a respective plurality of switchable valve train components, and the shaft may be common to each of the plurality of contacting elements.

According to a second aspect of the present invention, there is provided a valve train assembly of an internal combustion engine, the valve train assembly comprising: the actuation transmission apparatus according to the first aspect; a said actuation source; and at least one said switchable valve train component.

The switchable valve train component may be a switchable rocker arm.

The switchable rocker arm may comprise an inner body, and an outer body, and the latching arrangement may comprise a latch pin moveable between a latched position in which the inner body and the outer body are latched together and an unlatched position in which the inner body and the outer body are unlatched so that the first body and the second body are moveable relative to one another, and the latch pin may be biased to the latched position.

The switchable rocker arm may comprise a biasing element to bias the latch pin towards the latched position.

The contacting element may be arranged to actuate the latching arrangement by exerting a force on the latch pin in a direction away from the inner body and the outer body.

The latch pin may comprise a lateral pin for contacting the contacting element.

The actuation source may comprise an external rotary actuator.

According to a third aspect of the present invention, there is provided a method of actuating a latching arrangement for latching and unlatching a first body and a second body of a switchable valve train component of an internal combustion engine, the latching arrangement being biased from an unlatched position in which the first body and the second body are unlatched towards a latched position in which the latching arrangement latches the first body and the second body together, the method comprising: rotating a shaft so as to bias, when the latching arrangement is in an un-actuatable state, a biasing device that biases a contacting element rotationally with respect to the shaft, the contacting element being for contacting the latching arrangement, whereby the biasing device causes the contacting element to actuate the latching arrangement to the unlatched position when the latching arrangement becomes actuatable again.

Referring to FIGS. 1 to 4*b*, an actuation transmission apparatus 1 actuates a latching arrangement 15 of a switchable valve train component 2 (e.g. a switchable rocker arm 2) of a valve train assembly 5 of an internal combustion engine. The actuation transmission apparatus 1 transmits an actuation signal (force) from an actuation source 3 to the latching arrangement 15 of the switchable rocker arm 2.

The switchable rocker arm 2 comprises an outer body 6 and an inner body 4 that are pivotably connected together at a pivot axis 8. The rocker arm 2 comprises at one end the latching arrangement 15 comprising a latch pin 7 slidably supported in a bore 9 in the outer body 6 and which can be urged between a first, latched, position (see e.g. FIG. 4*a*) where the latch pin 7 latches the outer body 6 and the inner body 4 together and a second, unlatched, position (see e.g. FIG. 4*b*) where the outer body 6 and the inner body 4 are un-latched.

When the latching arrangement 15 is in the latched position, the rocker arm 2 is in a latched configuration. In the latched configuration, the outer body 6 and the inner body 4 are latched together and hence can move or pivot about a pivot point as a single body so that the that rocker arm 1 provides a first primary function, for example, an engine valve 11 that it controls is activated as a result of the rocker arm 2 pivoting as a whole about a pivot point (e.g. about a Hydraulic lash adjuster 5*a*) and exerting an opening force on the valve 11.

When the latching arrangement 15 is in the unlatched position, the rocker arm 2 is in an unlatched configuration. In the unlatched configuration, the outer body 6 and the inner body 4 are un-latched so that the inner body 4, for example, can pivot freely with respect to the outer body 6 about the pivot axis 8 so that rocker arm 1 provides a second secondary function, for example, the valve 11 it controls is de-activated as a result of lost motion absorbed by the inner body 4 pivoting freely with respect to the outer body 6 and hence no opening force being applied to the valve.

The inner body 4 is provided with an inner body cam follower 17, in this example, a roller follower 17 rotatably mounted (for example with bearings) on an axle 19 for following an auxiliary cam 38 on a cam shaft 32 (see e.g. FIGS. 4*a* and 4*b*) and the outer body 6 is provided with a pair of cam followers 23 (see e.g. FIG. 1), in this example, a pair of roller followers 23 arranged either side of the auxiliary cam roller follower 17 for following a pair of primary cam profiles mounted on the cam shaft 32.

The rocker arm 1 comprises a return spring arrangement 25 for biasing the inner body 4 to its rest position after it is has pivoted with respect to the outer body 6.

The latch arrangement 15 further comprises a return biasing device or spring 31 arranged around the latch pin 7, that is arranged to bias the latch pin 7 towards the latched position. The default configuration of the rocker arm 2 is therefore the latched configuration.

In some examples, the switchable rocker arm 2 (also referred to as a Switching Roller Finger Follower) may be the same or similar to that described in our application WO2013/156610. In essence, as with the above described example, the rocker arm comprises an inner body and an outer body, which may be latched together using a latching arrangement to provide one mode of operation (e.g. a first valve-lift mode) and unlatched, and hence can pivot with respect to each other, to provide a second mode of operation (e.g. a second valve-lift mode).

It is noted that in the default state, i.e. the de-actuated state, of the latching arrangement 15 of the switchable rocker arm 2 described herein, the latch pin 7 latches the inner body 4 and outer body 6 together, and in an actuated state, the inner body 4 and the outer body 6 are unlatched, i.e. the latch pin 7 is moved (i.e. actuated) so as to unlatch the inner body 4 and outer body 6 from one another. It is noted that this is different from the switchable rocker arm described in our application WO2013/156610, in which the default (i.e. de-actuated) state of the latch pin is unlatched. However, it will be appreciated that in some examples, the rocker arm 2 may be the same or similar to that described in WO2013/156610 in other respects.

In any case, it will be appreciated that the rocker arm 2 may be any rocker arm 2 comprising a plurality of bodies that move relative to one another, and which are latched together to provide one mode of operation (valve-lift mode) and are unlatched, and hence can move with respect to each other, to provide a second mode of operation (valve-lift mode). For example, rocker arm 2 may configured for internal Exhaust Gas Recirculation (iEGR), Cylinder Deactivation (CDA), Early Exhaust Valve Opening (EEVO), or the like applications.

The actuation transmission apparatus 1 comprises a shaft 10 that is mechanically coupled to the actuation source 3 such that the shaft 10 is rotatable by the actuation source 3, a contacting element 12 for contacting the latching arrangement 15 of the rocker arm 2, and a biasing device 14 to bias the contacting element 12 rotationally with respect to the shaft 10. The actuation transmission apparatus 1 also comprises a pre-load element 26 attached to the shaft 10 and having a radial protrusion 26*a* for contacting the biasing device 14.

In overview, in use, the biasing device 14 becomes biased by the pre-load element 26 of the shaft 10 when the actuation source 3 rotates the shaft 10, when the actuation source 3 attempts to actuate the latching arrangement 15 of the rocker arm 2, via the contacting element 12, when the latching arrangement 15 of the rocker arm 2 is in an un-actuatable state. The biasing device 14 so energised can then cause the contacting element 12 to actuate the latching arrangement 15 of the rocker arm 2 when latching arrangement 15 next becomes actuatable.

Figure 3:
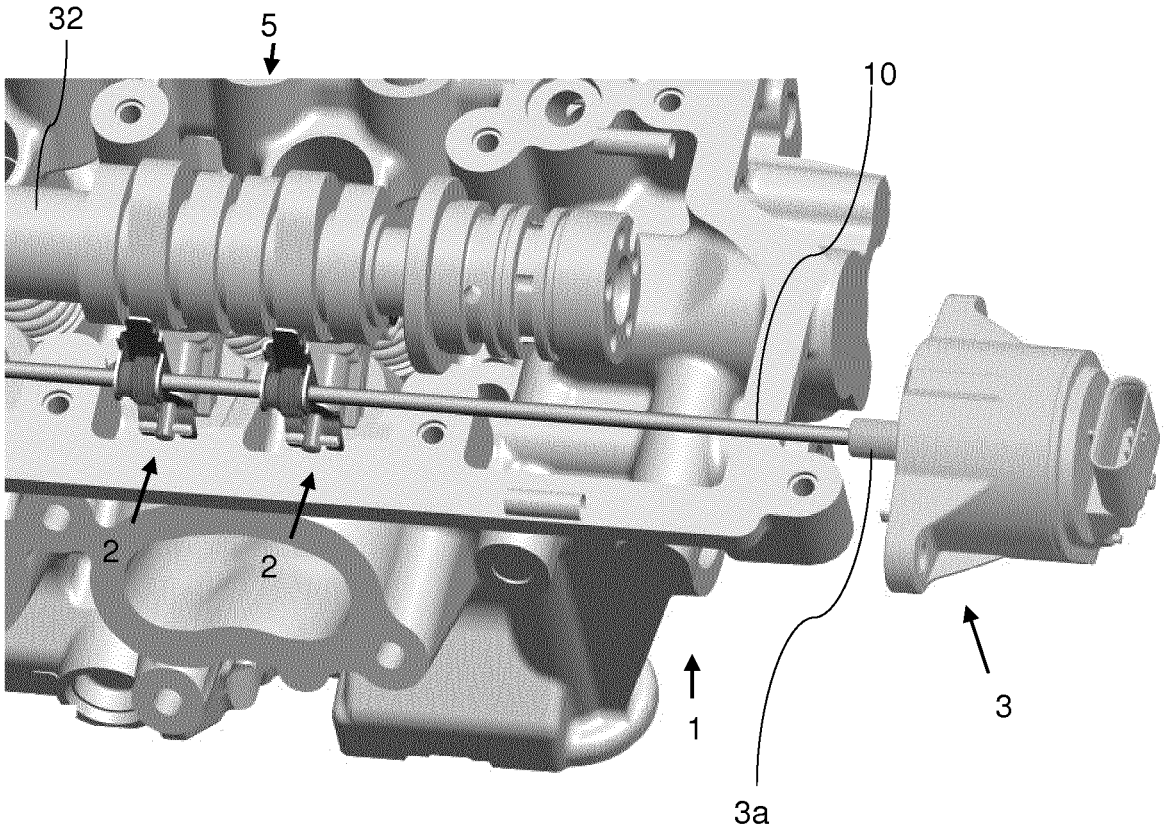
FIG. 3 schematically illustrates another perspective view a portion of the valve train assembly of FIG. 1.

As best seen in FIG. 3, the actuation source 3 (also referred to herein as an actuator 3) comprises an external rotary actuator 3 having a drive shaft 3*a* that can be controlled to rotate about its axis. In this example, the rotary actuator 3 is an electric motor. That is the actuation of the latch pin 7 may be referred to as electromechanical. In other examples, the rotary actuator 3 may be hydraulic, and/or pneumatic, for example. The external rotary actuator 3 may be mounted to the head or the cam cover of the engine. The axis of rotation of the drive shaft 3*a* is parallel with the axis of rotation of the shaft 10. Specifically, the axis of rotation of the drive shaft 3*a* is co-linear with the axis of rotation of the shaft 10. The drive shaft 3*a* of the rotary actuator 3 is attached to the shaft 10. The drive shaft 3*a* may be caused to rotate when actuation of the switchable rocker arm 2 is required. The drive shaft 3*a* may be limited in its extent of rotation, for example only between certain angles. The drive shaft 3*a* may be controlled to rotate via a controller arranged to control the rotary actuator 3. The shaft 10 may be mounted, for example, in a cam carrier or a cam cover of the engine.

Figure 4A:
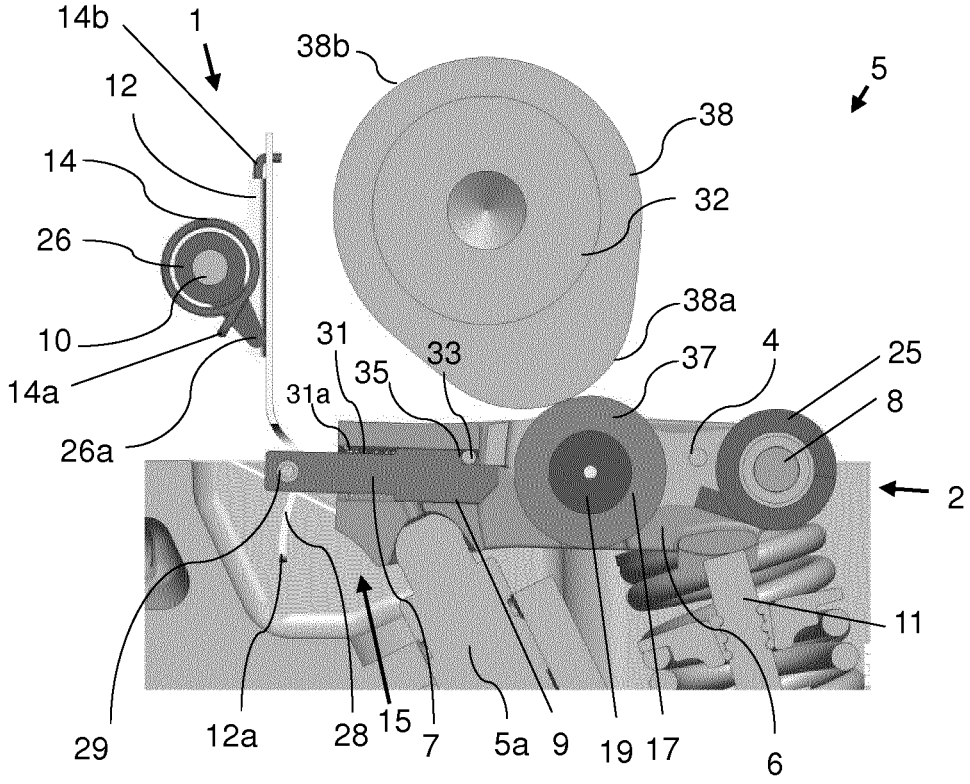
FIGS. 4*a* and 4*b* schematically illustrate part-sectional views of the portion of the valve train assembly of FIG. 1, when the rocker arm is in a latched and unlatched configuration, respectively.
Figure 4B:
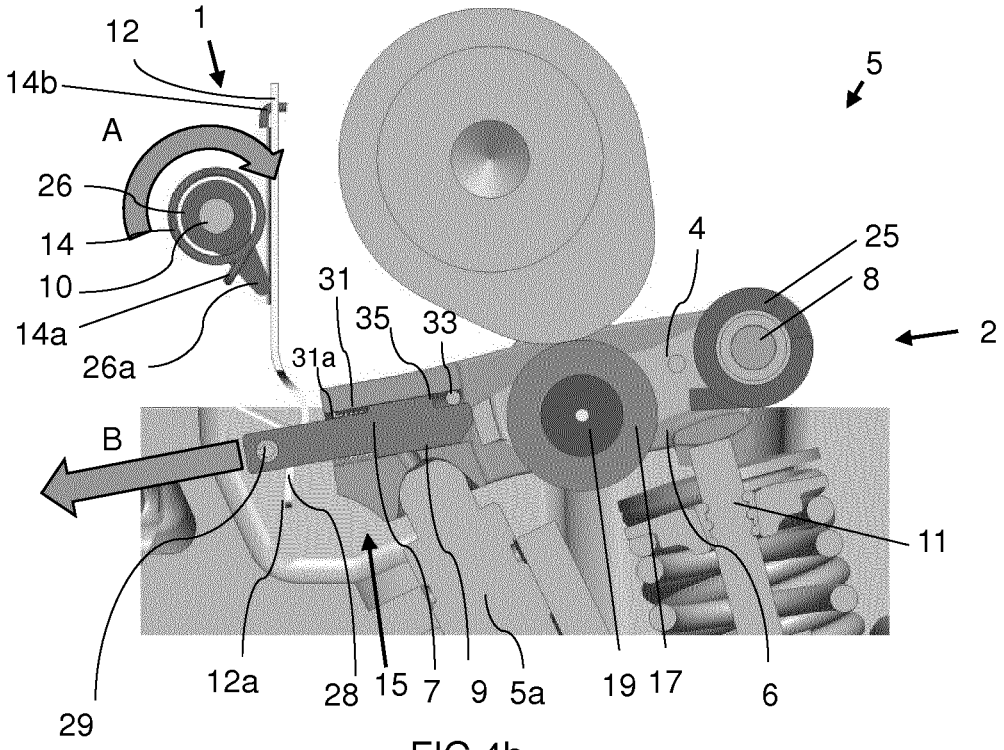

As perhaps best seen in FIGS. 4*a* and 4*b*, the shaft 10 is mechanically coupled to the contacting element 12 via the biasing device 14 and the pre-load element 26. The biasing device 14 is a coil spring 14. The coil spring is arranged around the shaft 10. Specifically, the coil spring 14 is wrapped around the pre-load element 26 which itself is wrapped around, or mounted on, the shaft 10. The pre-load element 26 is for transferring a torque from the shaft 10 to the biasing device 14. A first end 14*a* of the coil spring 14 abuts against the radial protrusion 26*a* of the pre-load element 26, and a second end 14*b* of the coil spring 14 abuts against the contacting element 12 thereby to bias the contacting element 12 rotationally with respect to the shaft 10, away from rocker arm 2. The shaft 10 may rotate with respect to contacting element 12, but in doing so the biasing device 14 will become energised, and will urge the contacting element 12 to follow the rotation of the shaft 10.

The contacting element 12 extends radially from the shaft 10, and has at a first end 12*a* a contacting feature 28 for contacting with the latch pin 7 of the rocker arm 2. Specifically, the latch pin 7 comprises a lateral pin 29 extending radially out from the latch pin 7, and, when actuation is required, the contacting feature 28 of the contacting element 12 contacts the lateral pin 29 to apply a force on the latch pin 7 away from the outer body 6 of the rocker arm 2 in which the latch pin 7 is received. The lateral pin 29 may be, for example, a spring pin 29 pressed into the latch pin 7. The contacting feature 28 has a curved shape so as to reduce wear of the contact surface and to enable the contacting element 28 to apply a force on the latch pin 7 away from the outer body of the rocker regardless of rotation of the outer body 6 about the hydraulic lash adjuster 5*a* during the engine cycle.

The latch pin 7 is received in the outer arm 6. The latch pin 7 comprises a biasing element 31 that biases the latch pin 7 to the latched position, i.e. towards a position in which the latch pin 7 latches the inner body 4 and the outer body 6 together. The outer body comprises a stop 33 received in a recess 35 of the latch pin, and limits the extent to which the latch pin 7 may move inward of the outer arm 6. At the recess 35, the latch pin 7 also defines a surface or ledge 35*a* against which the inner arm 4 contacts when the latch pin 7 is in the latched position.

Figure 2:
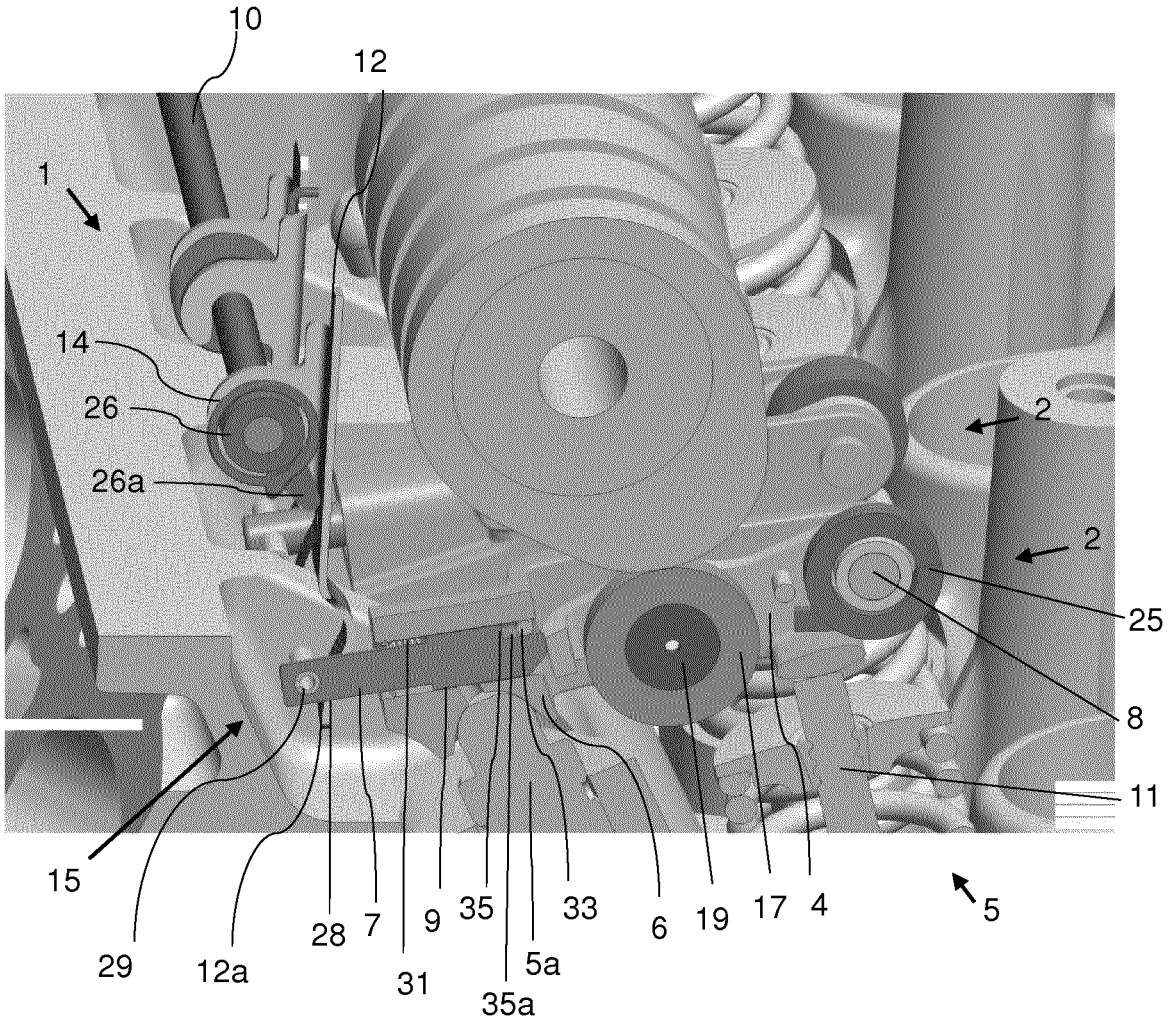
FIG. 2 schematically illustrates a part-sectional view through a portion of the valve train assembly of FIG. 1.

FIGS. 1 to 3 illustrate two rocker arms 2 on intake valve positions in the valve train assembly 5 of the engine.

The actuation transmission apparatus 1, in response to rotation of the drive shaft 3*a* of the actuator 3, actuates (e.g. moves) the latch pin 7, against the biasing element 31, to unlatch the inner body 4 from the outer body 6 of the rocker arm 2. In other words, the switchable rocker arm 2 is actuated when the latch pin 7 is moved, by the contacting element 12, from a latched position in which the inner body 4 and the outer body 6 are latched together to an unlatched position in which the inner body 4 and the outer body 6 are unlatched so that the first body and the second body are moveable relative to one another. When de-actuation is required, the drive shaft 3*a* is rotated back again such that substantially no force is applied to the latch pin 7 by the contacting element 12, and the latch pin is de-actuated (e.g. moved) under the force of the biasing element 31 to latch the inner body 4 and the outer body 6 together.

FIG. 4*a* illustrates the rocker arm 2 with the latch pin 7 in the default latched position (also referred to as the normally closed position). FIG. 4*b* illustrates the rocker arm 2 with the latch pin 7 in the actuated, unlatched position (also referred to as the open position).

As best illustrated in FIGS. 4*a* and 4*b*, when actuation of the latching arrangement 15 of the switchable rocker arm 2 is required (e.g. to provide for a first mode of operation), the drive shaft 3*a* rotates (clockwise in the sense of FIG. 4*b*) which exerts an actuation torque on the shaft 10 (clockwise in the sense of FIG. 4*b*, see arrow A), which causes the radial protrusion 26*a* of the pre-load element 26 to exert a (torque) force on the coiled spring 14, which in turn causes the contacting element 12 to be urged into rotation (clockwise in the sense of FIG. 4*a*) to contact the lateral pin 29 of the latch pin 7 of the rocker arm 2, thereby to urge the latch pin 7 out and away from the outer body 6 of the rocker arm 2 (see arrow B of FIG. 4*b*). In other words, the contacting element 12 exerts a force on the latch pin 7 in a direction away from the inner body 4 and the outer body 6.

If the latch pin 7 of the rocker arm 2 is actuatable (i.e. is free to move) then the force of the contacting element 12 pushing against the latch pin 7 will be sufficient to actuate the latch pin 7 immediately, hence unlatching the inner arm 4 and the outer arm 6 from one another. In other words, when the actuation source 3 rotates the shaft 10 when the actuation source 3 attempts to actuate the latching arrangement 15, via the contacting element 12, when the latching arrangement 15 is actuatable, the contacting element 12 actuates the latching arrangement 15 to the unlatched position immediately. A lift mode that the rocker arm 2 provides may therefore be altered immediately, for example from a second lift mode to a first lift mode.

However, in some cases, the latch pin 7 may be in an un-actuatable state (i.e. not be free to move). For example, the actuation of the latch pin 7 may not be possible immediately due to an engine condition. For example, as illustrated in FIG. 4*a*, a lift profile 38*a* of secondary lift cam 38 of a camshaft 32 may be engaged with the secondary lift roller 17 of the inner arm 4 of the rocker arm 2. In this case, the secondary lift cam 38 applies a force to the inner arm 4 that presses the inner arm 4 against the latch pin 7 to such an extent that the latch pin 7 cannot be easily moved out and away from the outer arm 6. In this case, the contacting element 12 will be restricted (blocked) from rotating with the shaft 10, and instead the rotation of the shaft 10 will cause, via the pre-load element 26, the biasing device (spring) 14 to be energised (i.e. to elastically deform from its natural configuration). That is, the spring 14 absorbs the actuation signal in case the switchable component 2 cannot be activated directly. As soon as (i.e. the instant that) the latch pin 7 becomes actuatable (i.e. free to move) again (e.g. as soon as the base circle 38*b* of the secondary lift cam 38 of the camshaft 32 is engaged with the secondary lift roller 17 of the inner arm 4 of the rocker arm 2, and hence there is substantially no force pressing the inner body 4 and the latch pin 7 together), the energy stored in the biasing of the spring 14 will cause the contacting element 12 to rotate (clockwise in the sense of FIG. 4*a*), and hence cause the latch pin 7 to be actuated (that is to move out and away from the outer arm 6), hence unlatching the inner arm 4 and the outer arm 6 from one another (and hence allowing for a function provided by the rocker arm 2 to be changed from, say, a second lift mode to a first lift mode). That is, as soon as an engine condition allows for the latch pin 7 to be actuated, the biasing device 14 will return to its natural, non-deformed state, and transmit the actuation signal/energy to the latch pin 7. That is, as soon as the engine condition allows for the latching arrangement 15 to be actuated, the coiled spring 14 will expand again and transmit the signal to the latching arrangement 15.

As a result, regardless of the restricted or unrestricted state of the latch pin 7 (i.e. regardless of the actuatable or un-actuatable state of the latching arrangement 15 of the switchable valve train component e.g. rocker arm 2), the latch pin 7 may be actuated as soon as it is possible to do so, i.e. as soon as the rocker arm 2 is not in a state which restricts actuation of the latch pin 7. In other words, the actuation of the rocker arm 2 from, say, a second lift mode to a first lift mode, is in effect delayed with respect to the actuation signal/force coming from the actuator 3 to the earliest possible time that such actuation is (physically) possible.

At a later stage, the drive shaft 3*a* of the actuator 3 may return to its original position (e.g. when de-actuation is required), and hence the contacting element 12 ceases to apply a force on the latch pin 7, and hence the latch pin 7 may return to its default, latched position under force of a the biasing element (coiled spring) 31, acting at one end against a stop 31*a* attached to the outer arm 6 and at the other against the latch pin 7, that biases the latch pin 7 to its default, latched position.

The above solution allows easy packaging and installation of the actuation transmission apparatus 1 on an engine. As mentioned above, when the actuation of the latching arrangement 15 of the switchable component 2 is not possible immediately due to the engine condition, the transmission apparatus 1 allows for the actuation to happen as soon as possible. The solution allows the actuation of the latching arrangement 15 by a limited rotation or translation of the actuation apparatus 1, reducing the impact to the engine's layout and the number and complexity of the actuation system components. The installation of the actuation transmission apparatus 1 on the engine is simple since a limited number of installation points are required on the engine and it can be also installed inside plastic covers.

The above are to be understood as illustrative examples only. For example, the storing of the signal/energy/force can be achieved by any suitable elastic element, e.g. any suitable biasing device.

The transmission apparatus 1 may actuate and/or de-actuate a latching arrangement of any switchable engine or valve train component (not necessarily a rocker arm 2).

The transmission apparatus 1 may transmit the actuation signal/force from an actuator 3 rotation, or a linear actuation force, form one point to another.

As seen in FIGS. 1 to 3, the actuation transmission apparatus 1 may comprise a plurality of such contacting elements 12 for contacting the latching arrangements 15 of a respective plurality of switchable valve train components 2. In this case, the shaft 10 may be common to each of those plurality of contacting elements 12, so that the latching arrangements 15 of multiple switchable components (e.g. rocker arms 2) may be actuated at the same time.

The transmission apparatus 1 may allow for the actuation of the latching arrangements of various switchable valve train components (e.g. rocker arm 2) to happen as soon as possible. The transmission apparatus 1 may therefore capture and store the actuation signal or energy and transmit it to the latching arrangement 15 of the switchable component 2 as soon as the actuation can happen. Indeed, the transmission apparatus 1 may capture and store an actuation signal or energy and transmit the actuation signal to each of the latching arrangements 15 of a plurality of switchable components 2 as soon actuation is possible for each of the latching arrangements 15 of the respective plurality of switchable components 2. The storing of the signal/energy can be achieved by the means of any elastic element 14.

The mechanical connection between the actuator 3 and the shaft 10 may be for example electrical, hydraulic, and/or pneumatic and can be simple. This mechanical connection can be the last operation when assembling the engine.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1 actuation transmission apparatus
2 rocker arm
3 actuation source
3*a* drive shaft
4 inner body
5 valve train assembly
5*a* hydraulic lash adjuster
6 outer body
7 latch pin
8 pivot axis
9 bore
10 shaft
11 valve
12 contacting element
14 biasing device
14*a* first end of biasing device
14*b* second end of biasing device
15 latching arrangement
17 inner body cam follower
19 axle
23 roller followers
25 return spring arrangement
26 pre-load element
26*a* radial protrusion
28 contacting feature
29 lateral pin
31 biasing element
31*a* stop
32 cam shaft
33 stop
35 recess
35*a* surface
38 secondary lift cam
38*a* lift profile
38*b* base circle

The invention claimed is:

1. An actuation transmission apparatus for actuating a latching arrangement for latching and unlatching a first body and a second body of a switchable valve train component of an internal combustion engine, the latching arrangement being biased from an unlatched position where the first body and the second body are unlatched towards a latched position where the latching arrangement latches the first body and the second body together, the actuation transmission apparatus comprising:

a shaft rotatable by an actuation source;

a contacting element configured to contact the latching arrangement; and a biasing device configured to bias the contacting element rotationally with respect to the shaft;

wherein, in use, the biasing device is configured to become biased by the shaft when the actuation source rotates the shaft when the actuation source attempts to actuate the latching arrangement to the unlatched position, via the contacting element, when the latching arrangement is in an un-actuatable state, whereby the biasing device is configured to cause the contacting element to actuate the latching arrangement to the unlatched position when the latching arrangement becomes actuatable again.

2. The actuation transmission apparatus according to claim 1, wherein the biasing device comprises a coil spring arranged around the shaft.

3. The actuation transmission apparatus according to claim 2, wherein the actuation transmission apparatus comprises a pre-load element configured to transfer a torque from the shaft to the coil spring.

4. The actuation transmission apparatus according to claim 3, wherein a first end of the coil spring contacts a protrusion of the pre-load element and a second end of the coil spring contacts the contacting element to bias the contacting element rotationally with respect to the shaft.

5. The actuation transmission apparatus according to claim 1, wherein the contacting element extends radially from the shaft.

6. The actuation transmission apparatus according to claim 1, wherein, in use, when the actuation source rotates the shaft when the actuation source attempts to actuate the latching arrangement, via the contacting element, when the latching arrangement is actuatable, the contacting element actuates the latching arrangement to the unlatched position immediately.

7. The actuation transmission apparatus according to claim 1, wherein the actuation transmission apparatus comprises a plurality of the contacting element configured to contact a respective plurality of the latching arrangement of a respective plurality of the switchable valve train component, and wherein the shaft is common to each of the plurality of contacting elements.

8. A valve train assembly of an internal combustion engine, the valve train assembly comprising:

the actuation transmission apparatus according to claim 1;

the said actuation source; and at least one of the switchable valve train component.

9. The valve train assembly according to claim 8, wherein the switchable valve train component comprises a switchable rocker arm.

10. The valve train assembly according to claim 9, wherein the switchable rocker arm comprises an inner body and an outer body, wherein the latching arrangement comprises a latch pin moveable between a latched position in which the inner body and the outer body are latched together and an unlatched position in which the inner body and the outer body are unlatched so that the inner body and the outer body are moveable relative to one another, and wherein the latch pin is biased to the latched position.

11. The valve train assembly according to claim 10, wherein the switchable rocker arm comprises a biasing element configured to bias the latch pin towards the latched position.

12. The valve train assembly according to claim 10, wherein the contacting element is configured to actuate the latching arrangement by exerting a force on the latch pin in a direction away from the inner body and the outer body.

13. The valve train assembly according to claim 10, wherein the latch pin comprises a lateral pin configured to contact the contacting element.

14. The valve train assembly according to claim 8, wherein the actuation source comprises an external rotary actuator.

15. A method of actuating a latching arrangement for latching and unlatching a first body and a second body of a switchable valve train component of an internal combustion engine, the latching arrangement being biased from an unlatched position in which the first body and the second body are unlatched towards a latched position in which the latching arrangement latches the first body and the second body together, the method comprising:

rotating a shaft so as to bias, when the latching arrangement is in an un-actuatable state, a biasing device configured to bias a contacting element rotationally with respect to the shaft, the contacting element being configured to contact the latching arrangement, whereby the biasing device causes the contacting element to actuate the latching arrangement to the unlatched position when the latching arrangement becomes actuatable again, wherein rotating the shaft occurs upon an actuation source attempting to actuate the latching arrangement to the unlatched position.

* * * * *